US007444281B2

(12) United States Patent
Sundqvist et al.

(10) Patent No.: US 7,444,281 B2
(45) Date of Patent: Oct. 28, 2008

(54) METHOD AND COMMUNICATION APPARATUS GENERATION PACKETS AFTER SAMPLE RATE CONVERSION OF SPEECH STREAM

(75) Inventors: Jim Sundqvist, Luleå (SE); Fredrik Jansson, Sundbyberg (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 1068 days.

(21) Appl. No.: 10/451,382

(22) PCT Filed: Dec. 14, 2001

(86) PCT No.: PCT/SE01/02797

§ 371 (c)(1),
(2), (4) Date: Nov. 6, 2003

(87) PCT Pub. No.: WO02/052240

PCT Pub. Date: Jul. 4, 2002

(65) Prior Publication Data

US 2004/0071132 A1 Apr. 15, 2004

(30) Foreign Application Priority Data

Dec. 22, 2000 (SE) ..... 0004838

(51) Int. Cl.
*G10L 19/00* (2006.01)
*G10L 19/04* (2006.01)

(52) U.S. Cl. ..... 704/201; 704/211; 704/219

(58) Field of Classification Search ..... 704/201, 704/211, 219

See application file for complete search history.

(56) References Cited

U.S. PATENT DOCUMENTS

| | | | | |
|---|---|---|---|---|
| 5,790,538 | A | 8/1998 | Sugar | |
| 5,845,243 | A * | 12/1998 | Smart et al. | 704/200.1 |
| 5,923,655 | A | 7/1999 | Veschi et al. | |
| 6,108,626 | A * | 8/2000 | Cellario et al. | 704/230 |
| 6,563,802 | B2 * | 5/2003 | Hayward | 370/286 |
| 6,765,931 | B1 * | 7/2004 | Rabenko et al. | 370/493 |
| 6,771,703 | B1 * | 8/2004 | Oguz et al. | 375/240.03 |

FOREIGN PATENT DOCUMENTS

| | | |
|---|---|---|
| WO | 00/33520 A1 | 6/2000 |
| WO | 00/67417 A1 | 11/2000 |

OTHER PUBLICATIONS

International Search Report mailed Mar. 25, 2002 in corresponding PCT application PCT/SE01/02797.
International Preliminary Examination Report mailed Jan. 10, 2003 in corresponding PCT application PCT/SE01/02797.

* cited by examiner

*Primary Examiner*—Talivaldis Ivars Smits
*Assistant Examiner*—Douglas C Godbold
(74) *Attorney, Agent, or Firm*—Nixon & Vanderhye, P.C.

(57) ABSTRACT

A method for generating speech packets and a communication apparatus implementing the method and functioning as a first node of a communication system. A first stream of digital speech samples having a first sample rate is provided (201). If the first sample rate is determined (202) as not matching a required sample rate, said speech packets are generated (204) based on a second stream of digital speech samples generated (203) by performing sample rate conversion of the first stream of digital speech samples.

20 Claims, 3 Drawing Sheets

METHOD AND COMMUNICATION APPARATUS GENERATION PACKETS AFTER SAMPLE RATE CONVERSION OF SPEECH STREAM

This application is the U.S. National phase of international application PCT/SEO1/02797 filed 14 Dec. 2001 which designates the U.S.

TECHNICAL FIELD OF THE INVENTION

The invention relates to a method for generating speech packets and a communication apparatus implementing said method in a communication system.

DESCRIPTION OF RELATED ART

Currently, there is a strong trend in the telecommunication business to merge data and voice traffic into one network using packet switched transmission technology. This trend, often referred to as "Voice over IP" or "IP-telephony", is now also moving into the world of cellular radio communications.

One problem associated with IP-telephony communication systems, is that individual speech packets in a stream of speech packets generated and transmitted from an originating node to a receiving node in the communication system, experiences stochastic transmission delays, which may even cause speech packets to arrive at the receiving node in a different order than they were transmitted from the originating node. In order to cope with the variable transmission delays, causing so-called jitter in the time of arrival of the speech packets at the receiving node and potentially even resulting in packets arriving in a different order than transmitted, the receiving node is typically provided with a jitter buffer used for sorting the speech packets into the correct sequence and delaying the packets as needed to compensate for transmission delay variations, i.e. the packets are not played back immediately upon arrival.

Another problem that is present in "IP-telephony" as opposed to traditional circuit switched telephony is that the clock that controls sampling frequency, and thereby the rate at which speech packets are produced by the originating node, is not locked to, or synchronized with, the clock controlling the sample playout rate at the receiving node. In an "IP-telephony" call involving two personal computers (PC), it is typically the sound board clocks of the PCs that controls the respective sampling rates which is known to cause problems. As a result of the difference in clock rates at the originating node and the receiving node, so called clock skew, the receiving node may experience either buffer overflow or buffer underflow in the jitter buffer. If the clock at the originating node is faster than the clock at the receiving node, the delay in the jitter buffer will increase and eventually cause buffer overflow, while if the clock at the originating node is slower than the clock at the receiving node, the receiving node will eventually experience buffer underflow.

One way of handling clock skew has been to perform a crude correction whenever needed. Thus, upon encountering buffer overflow of the jitter buffer, packets may be discarded while upon encountering buffer underflow of the jitter buffer, certain packets may be replayed to avoid pausing. If the clock skew is not too severe, then such correction may take place once every few minutes which may be perceptually acceptable. However, if the clock skew is severe, then corrections may be needed more frequently, up to once every few seconds. In this case, a crude correction will create perceptually unacceptable artefacts.

U.S. Pat. No. 5,699,481 teaches a timing recovery scheme for packet speech in a communication system comprising a controller, a speech decoder and a common buffer for exchanging coded speech packages (CSP) between the controller and the speech decoder. The coded speech packages are generated by and transmitted from another communication system to the communication system via a communication channel, such as a telephone line. The received coded speech packets are entered into the common buffer by the controller. Whenever the speech decoder detects excessive or missing speech packages in the common buffer, the speech decoder switches to a special corrective mode. If excessive speech data is detected, it is played out faster than usual while if missing data is detected, the available data is played out slower than usual. Faster playout of data is effected by the speech decoder discarding some speech information while slower playout of data is effected by the speech decoder synthesizing some speech-like information. The speech decoder may modify either the synthesized output speech signal, i.e. the signal after complete speech decoding, or, in the preferred embodiment, the intermediate excitation signal, i.e. the intermediate speech signal prior to LPC-filtering. In either case, manipulation of smaller duration units and silence or unvoiced units results in better quality of the modified speech.

BRIEF SUMMARY

A problem dealt with by the present technology is to combat speech quality degradations in a communication system caused by differences in clock rates in a first node generating speech packets and a second node receiving the generated speech packets The problem is solved essentially by a method of generating speech packets in the first node wherein if the sample rate of a first stream of digital speech samples provided in the first node does not match a required sample rate, said speech packets are generated based on a second stream of digital speech samples generated by performing sample rate conversion of the first stream of digital speech samples. The technology includes a communication apparatus with the necessary means for implementing the method.

One object of the technology is to combat speech quality degradations in a communication system caused by differences in clock rates in a first node generating speech packets and a second node receiving the generated speech packets.

Another object of the technology is to provide improved control of the rate at which the speech packets are generated at the first node.

One advantage afforded by the technology is that the occurrence of speech quality degradations as a consequence of differences in clock rates in a first node generating speech packets and a second node receiving the generated speech packets can be reduced.

Another advantage afforded by the technology is that improved control over the rate at which speech packets are generated at a first node in a communication system.

The technology will now be described in more detail with reference to exemplary embodiments thereof and also with reference to the accompanying drawings.

DETAILED DESCRIPTION OF THE EMBODIMENTS

Figure 1:
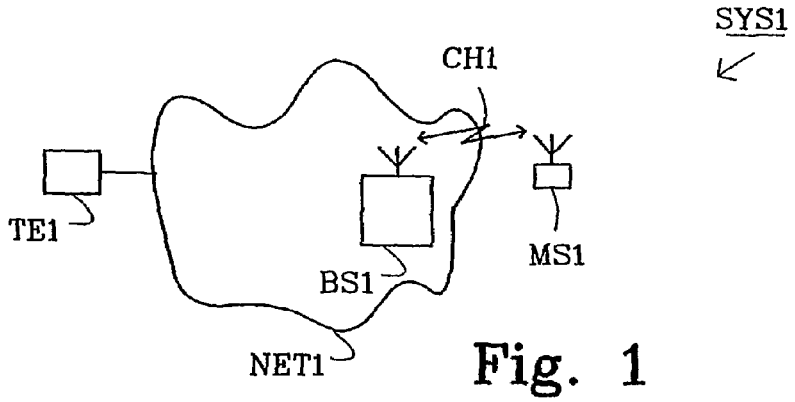
FIG. 1 is a schematic view of an example embodiment of a communication system in which the technology is applied.

FIG. 1 illustrates an exemplary communication system SYS1 in which the present technology is applied. The communication system comprises a fixed terminal TE1, e.g. a personal computer, a packet switched network NET1, which typically is implemented as an internet or intranet comprising a number of subnetworks, and a mobile station MS1. The packet switched network NET1 provides packet switched communication of both speech and other user data and includes a base station BS1 capable of communicating with mobile stations, including the mobile station MS1. Communications between the base station BS1 and mobile stations occur on radio channels according to the applicable air interface specifications. In the exemplary communication system SYS1, the air interface specifications provides radio channels for packet switched communication of data over the air interface. However for transport of speech over the air interface, radio channels are provided which are basically circuit switched and identical to or very similar to the radio channels provided in circuit switched GSM systems. The use of such radio channels is actually the current working assumption in the ETS1 standardization of Enhanced GPRS (EGPRS) and GSM/EDGE Radio Access Network (GERAN) for how packet switched speech should be transported over the air interface.

Thus, in an examplary scenario of a voice communication session, i.e. a phone call, involving a user at the fixed terminal TE1 and a user at the mobile station MS1, voice information is communicated between the fixed terminal TE1 and the base station BS1 using a packet switched mode of communication. The well known real-time transport protocol (RTP), User Datagram Protocol (UDP) and Internet Protocol (IP) specified by IETF are used to convey speech packets, including blocks of compressed speech information, between the fixed terminal TE1 and the base station BS1. At the base station BS1, the RTP, UDP and IP protocols are terminated and the blocks of compressed speech information are transported between the base station BS1 and the mobile station MS1 over a circuit switched radio channel CH1 assigned for serving the phone call. The radio channel CH1 being circuit switched implies that the radio channel CH1 is dedicated to transport blocks of speech information associated with the call at a fixed bandwidth.

In order to manage variations in transmission delay, which individual packets experience when being transmitted through the packet switched network NET1 from the fixed terminal TE1 to the base station BS1, the base station BS1 includes a jitter buffer JB1 associated with the radio channel CH1.

In the exemplary communication system SYS1 of FIG. 1, the radio channel CH1 is adapted to provide transmission of blocks of compressed speech information at a rate which requires that speech signal sampling is performed at a rate of 8 kHz, i.e. the traditional sampling rate used for circuit switched telephony. However, even though a fixed terminal in the communication system SYS1 is supposed to use a sample rate of 8 kHz, it is quite probable that the actual sample rate provided by a soundboard in the fixed terminal deviates significantly from the required sample rate of 8 kHz. A typical sound board is often provided with a clock primarily adapted to provide a 44.1 kHz sample rate, i.e. corresponding to the sample rate of Compact Discs (CD), and a sample rate of approximately 8 kHz is then derived from the 44.1 kHz sample rate. As an example, a sample rate of 8.018 kHz may be derived from 44.1 kHz according to the expression $$44.1*10/55=8.018\text{ kHz} \quad (1)$$

Thus the problem of clock skew between a fixed terminal and the base station BS1 may occur frequently, causing a significant risk for a jitter buffer, e.g. jitter buffer JB1, in the base station BS1 to experience an ever increasing buffering delay which eventually causes buffer overflow and which results in speech quality degradations.

The present technology provides a way to combat speech quality degradations in a communication system caused by differences in clock rates in a first node generating speech packets and a second node receiving the generated speech packets.

Figure 2:
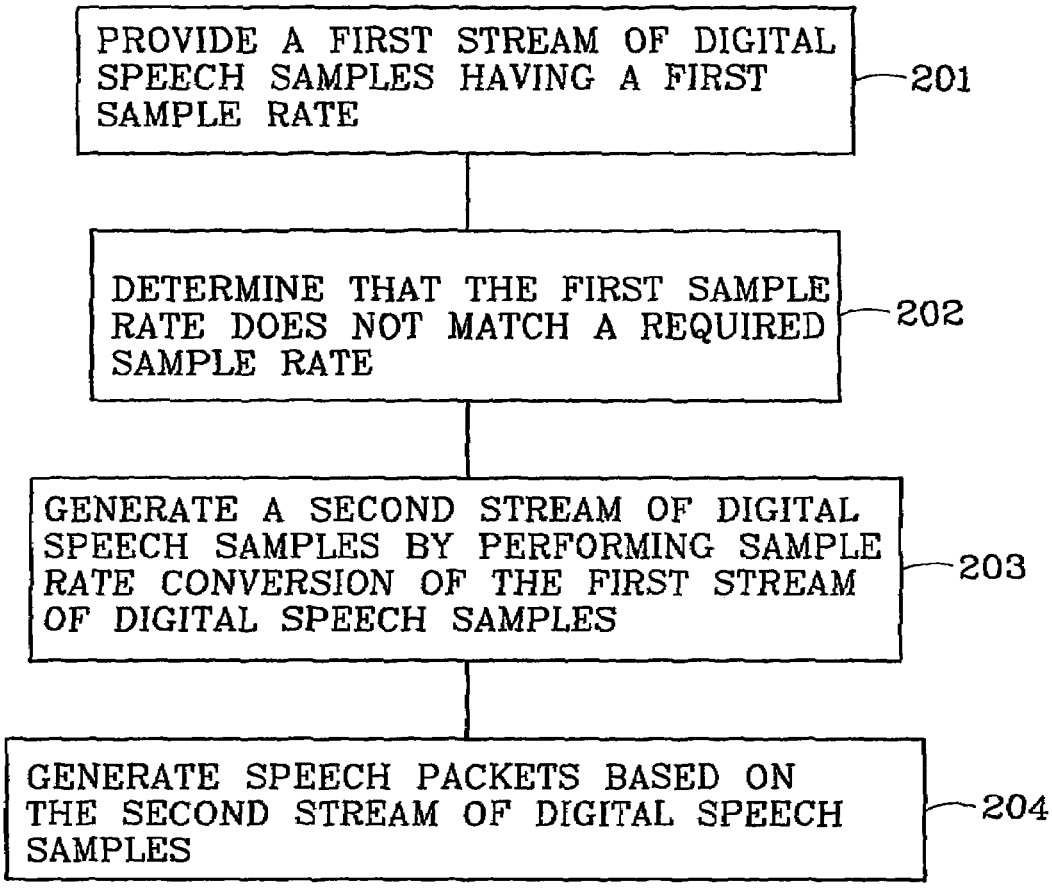
FIG. 2 is a flow diagram illustrating a basic method according to an example embodiment.

FIG. 2 illustrates a basic method according to an example embodiment for generating speech packets in a first node of a communication system, such as the fixed terminal TE1 in the communication system SYS1 of FIG. 1.

At step 201 a first stream of digital speech samples having a first sample rate is provided in the first node.

At step 202, it is determined that the first sample rate of the first stream of digital speech samples does not match a required sample rate.

At step 203 a second stream of digital speech samples having an average sampling rate equal to the required sample rate is generated by performing sample rate conversion of the first stream of digital speech samples.

Figure 3:
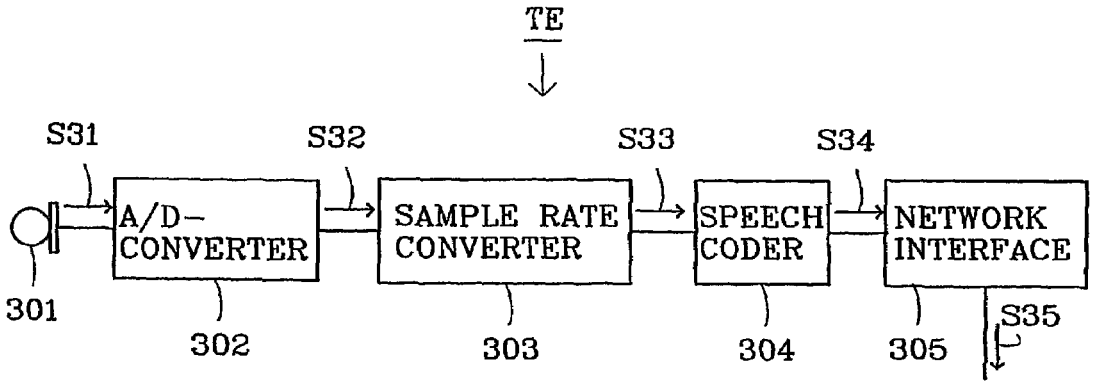
FIG. 3 is a schematic block diagram illustrating the internal structure of a fixed terminal according to a first exemplary embodiment of a communication apparatus.

At step 204 the speech packets are generated based on the second stream of digital speech samples. In some example embodiments, this step may include the substeps of generating blocks of compressed speech information based on the second stream of digital speech samples and including the generated blocks of compressed speech information in said speech packets. In other example embodiments, the speech packets may be generated by directly including sample subsequences of the second stream of digital speech samples into speech packets FIG. 3 illustrates in more details the internal structure of the fixed terminal TE1 in FIG. 1 according to a first exemplary embodiment of a communication apparatus. FIG. 3 only illustrates elements of the terminal TE1 which are deemed relevant to illustrate the present technology.

The fixed terminal TE1 includes a microphone 301, an analog-to-digital converter 302 , a sample rate converter 303, a speech coder 304 and a network interface 305.

The microphone 301 converts speech spoken by a user of the fixed terminal TE1 into an analog electrical speech signal S31.

The analog-to-digital converter 302 provides a first stream S32 of digital speech samples by performing analog-to-digital conversion of the analog speech signal S31 received from the microphone 301.

The sample rate converter 303 receives the first stream S32 of digital speech samples from the analog-to-digital converter 302 and determines whether the sample rate of the received first stream S32 of digital speech samples matches a required sample rate. If it is determined that the first stream S32 of digital samples S31 does not match the required sample rate, the sample rate converter 303 provides to the speech coder 304 a second stream S33 of digital speech samples having an average sampling rate equal to the required sample rate by performing sample rate conversion of the first stream S32 of digital speech samples. Otherwise, there is no need to perform any sample rate conversion and the sample rate converter just passes the first stream S32 of digital speech samples transparently to the speech coder 304.

The speech coder 304 generates blocks S34 of compressed speech information each encoded as a set of parameters representing speech segments of a fixed length. The speech coder 304 could be configured to support a number of different speech coding algorithms. In this exemplary embodiment, the speech coder is assumed to operate according to the GSM Adaptive Multi-Rate (AMR) specifications (see GSM 06.90) and thus each block of compressed speech information represents a 20 ms speech segment. Thus, the speech coder 304 produces one block of compressed speech information for each sequence of 160 samples it receives from the sample rate converter 303.

The network interface 305 generates one RTP-packet for each block of compressed speech information it receives from the speech coder 304 by including the block of compressed speech information in the payload field of the RTP-packet and adding the appropriate RTP, UDP and IP header field information. The network interface transmits the generated RTP-packets into the network NET1, which conveys the RTP-packets S35 to the base station BS1.

Figure 4:
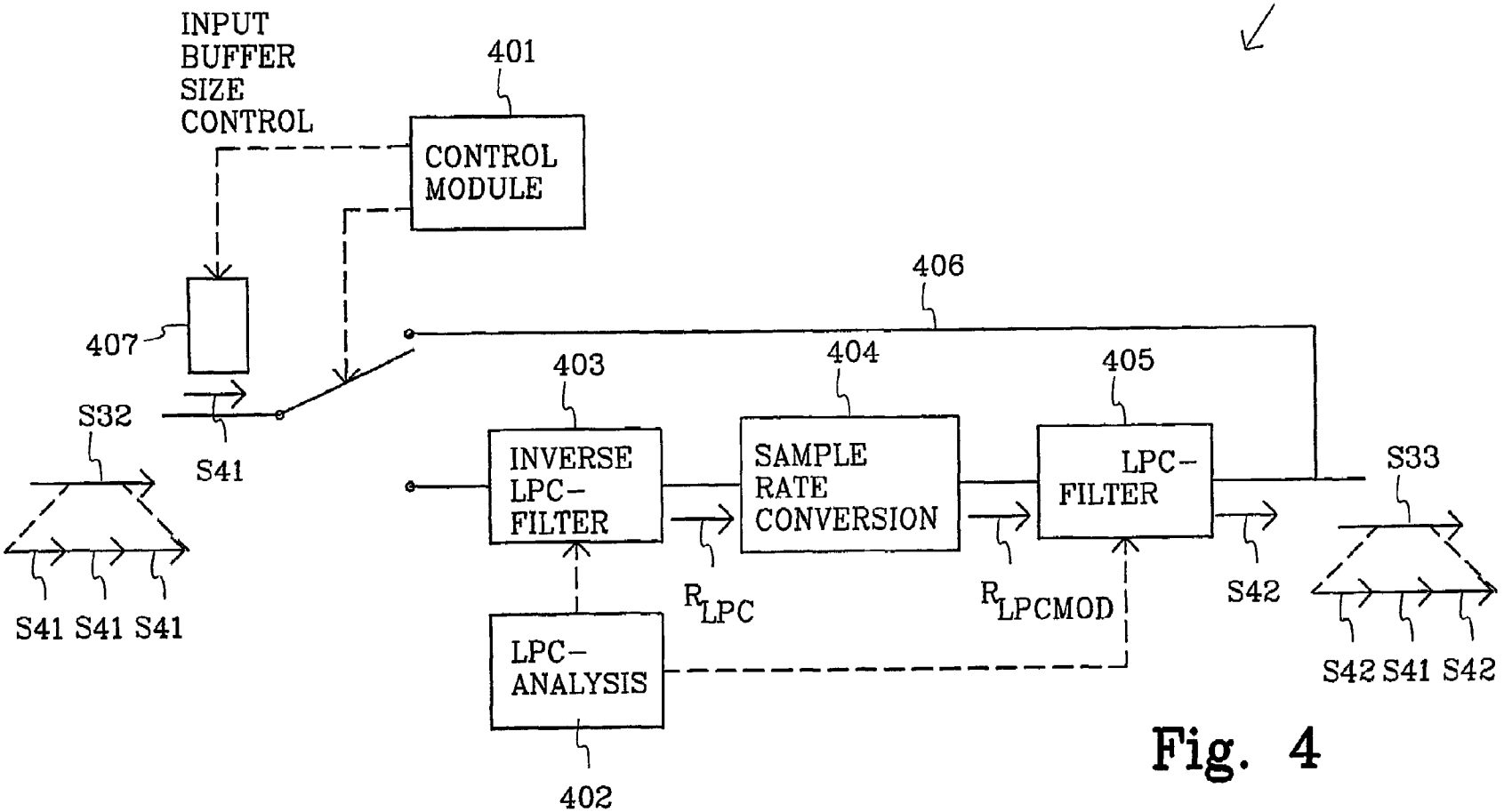
FIG. 4 is a block diagram illustrating details of the internal structure of a sample rate converter.

FIG. 4 illustrates in more detail the internal structure of the sample rate converter 303 in FIG. 2.

The sample rate converter 303 comprises a control module 401, a Linear Predictive Coding (LPC) analysis module 402, a inverse LPC-filter 403, a sample rate conversion module 404, and a LPC-filter 405.

The control module 401 continuously performs measurements to estimate the sample rate at which the analog-to-digital converter 302 operates, i.e. the sample rate of the first stream S32 of digital speech samples. The control module 401 is preferably adapted to continuously estimate a moving average of of the sample rate at which the analog-to-digital converter 302 operates. For each telephone call involving the fixed terminal TE1, the control module 401 provides an estimate of the sample rate during the call by measuring the number of samples produced by the analog-to-digital converter 302 during the call and dividing said number of samples by the duration of the call. Each new sample rate estimate is used to update the sample rate moving average so as to enable adjustment to possible variations in the sampling rate of the analog-to-digital converter 302. Preferably, measurement of the call duration is performed using a clock synchronized to a timing reference of high accuracy by e.g. using the Network Time Protocol (NTP).

The control module 401 retrieves the required sample rate from a memory unit (not shown) in which the required sample rate is stored as a configuration parameter. The required sample rate is in this case predetermined to be 8 kHz, which equals the sample rate of traditional circuit switched telephony in both fixed and cellular communication systems. 8 kHz is also the sample rate at which digital speech samples should be produced such that the speech coder 304 generates blocks of compressed speech information and the network interface 305 generates RTP-packets at the same rate as the blocks of compressed speech information are transmitted over a circuit switched radio channel.

The control module 401 compares the moving average value of the sample rate of the first stream S31 of digital speech samples and the required sample rate to determine whether the sample rates match each other, implying that there is no need for sample rate conversion, or whether there is a mismatch, implying that there is a need for performing sample rate conversion. The control module 401 would typically be implemented to consider whether the moving average value of the sample rate of the first stream S31 essentially matches the required sample rate, i.e. the two sample rates may be determined as matching each other even though they may be determined to differ slightly from each others. There are at least two reasons for allowing slight differences in the two sample rates and still consider them to be matching each other. One is that there is no reason to perform the matching operation using a higher degree of accuracy than the accuracy in the measurements of the moving average value of the sample rate of the first stream S32. Another reason is that it may be perceptually acceptable if the jitter buffer JB1 e.g. is forced to drop a block of compressed speech information once every minute or every few minutes as a consequence of the first sample rate slightly exceeding the required sample rate. As an example, assuming it would be acceptable for the jitter buffer JB1 to drop a block of compressed speech information once every minute, it would be acceptable if the fixed terminal TE1 produced 3001 instead of 3000 speech packets and blocks of compressed speech information each minute, i.e. a sample rate difference of 0.33 per mille would be considered acceptable.

The sample rate converter 303 receives sample subsequences S41 of the first stream S31 of digital speech samples from the analog-to-digital converter 302. The control module 401 continuously controls the length of the sample subsequences S41 the sample rate converter 303 receives by continuously controlling the buffer length of a buffer 407 via which the sample rate converter 303 receives said sample subsequences S41 from the analog-to-digital converter 302.

If there is no need for sample rate conversion, the control module 401 continuously sets the sample subsequence lengths to 160 digital speech samples, i.e. corresponding to the number of speech samples required by the speech coder 304 for generating one block of compressed speech information.

If the sample rate of the first stream S31 is less than the required sample rate, i.e. the sample rate converter must increase the sample rate, the control module 401 decreases the length of at least some of the sample subsequences S41 to less than 160 digital speech samples. How often and how much the subsequence lengths are decreased depends on how much the sample rate converter must increase the sample rate.

If the sample rate of the first stream S31 is greater than the required sample rate, i.e. the sample rate converter must decrease the sample rate, the control module 401 increases the length of at least some of the sample subsequences S41 to more than 160 digital speech samples. How often and how much the subsequence lengths are increased depends on how much the sample rate converter must decrease the sample rate.

The sample subsequences S41 consisting of 160 samples are passed transparently through the sample rate converter 303 via the bypass route 406, while the sample subsequences S41 consisting of less than or more than 160 samples are processed by modules 402-405 so as to produce modified sample subsequences S42 each consisting of 160 speech samples. Thus, if there is no need for sample rate conversion, the sample rate converter 303 passes all sample subsequences S41 of the first stream S32 of digital speech samples transparently to the speech coder 304, i.e. the speech coder 304 will receive and operate on the first stream S32 of digital speech samples. On the other hand, if sample rate conversion is necessary, the sample rate converter 303 may pass some sample subsequences S41 of the first stream S32 of digital speech samples transparently to the speech coder 304, but for those sample subsequences S41 consisting of a number of samples other than 160 samples, the sample rate converter 303 will generate modified sample subsequences S42 in which the number of samples have been increased or decreased to 160 samples and provide these modified sample subsequences S42 to the speech coder 304. Thus, if there is a need for sample rate conversion, the speech coder 304 will receive and operate on the second stream S33 of digital speech samples which may include sample subsequences S41 from the first stream of digital speech samples S31 but which will also include modified sample subsequences S42 as generated by the sample rate converter 303.

Figure 5:
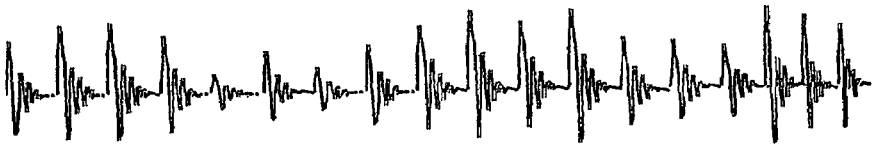
FIG. 5 is a diagram illustrating a speech signal in the time domain.

FIG. 5 illustrates a typical segment of a speech signal in the time domain. This speech signal shows a short-term correlation, which corresponds to the vocal tract, and a long-term correlation, which corresponds to the vocal cords. As is well known in the art, the short-term correlation of a speech signal can be predicted using a linear predictor, i.e. a Linear Predictive Coding (LPC) filter. Such an LPC-filter is usually denoted:

$$H(z) = \frac{1}{A(z)} = \frac{1}{1 - \sum_i a_i z^{-i}} \tag{1}$$

Figure 6:
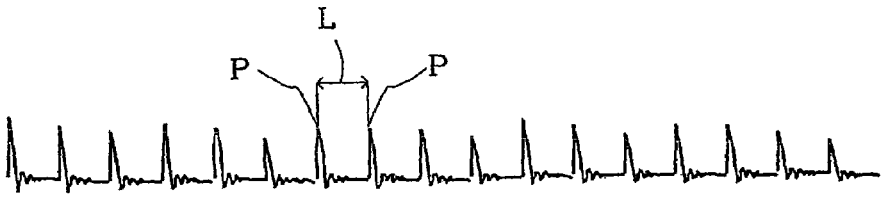
FIG. 6 is a diagram illustrating an LPC-residual of a speech signal in the time domain.

By feeding the speech signal segment through the inverse of the LPC-filter, a so called LPC-residual is derived. The LPC-residual, illustrated in FIG. 6, comprises pitch pulses P generated by the vocal cords and unpredictable data. The distance L between two pitch pulses is called lag. The LPC-residual can be seen as a pulse train on a noisy signal. The LPC-residual contains less information and less energy compared to the speech signal but the pitch pulses are still easy to locate. Samples in the LPC-residual being close to a pitch pulse P contain more information and thus have a greater influence on the speech signal segment than samples further away from a pitch pulse P.

When a sample subsequence S41 having a length other than 160samples is received via the buffer 407, the sample rate converter 303 operates as follows to generate a modified sample subsequence S42 of 160 samples.

The LPC-analysis module 402 determine coefficients of the LPC-inverse-filter 403 and the LPC-filter 405 by performing an LPC-analysis of the received sample subsequence S41 according to methods well known to a person skilled in the art.

An LPC-residual $R_{LPC}$ is generated by performing inverse LPC-filtering of the received sample subsequence S41 in the inverse LPC-filter 403.

The sample rate conversion module 404 generates a modified LPC-residual $R_{LPCMOD}$ comprising 160 samples by adding or deleting samples from the LPC-residual $R_{Lpc}$. There are several alternatives for how the rate conversion module 404 may determine suitable positions for adding or removing samples. One alternative would be to select positions for adding or removing samples arbitrarily. Another way would be to search for segments of the LPC-residual with low energy and add or remove samples in such low energy segments. This may e.g. be done by dividing the LPC-residual into blocks of equal length and removing or adding an arbitrary sample in the block with the lowest energy or by using knowledge about the position of a pitch pulse, and the lag between two pitch pulses, to select a position to add or remove a sample somewhere in the middle between two pitch pulses.

The modified subsequence S42 is finally generated by performing LPC-filtering of the modified LPC-residual $R_{LPCMOD}$ in the LPC-filter 405.

Apart from the exemplary first embodiment disclosed above, there are several ways of providing rearrangements, modifications and substitutions of the first embodiment resulting in additional example embodiments.

Instead of providing the first stream S32 of digital speech samples from the analog-to-digital converter 302 to the sample rate converter 303 via a buffer 407 whose length is continuously controlled by the control module 401, a fixed size buffer could be used in the interface between the analog-to-digital converter 302 and the sample rate converter 303. The buffer size would be selected to less than 160 samples, i.e. the number of samples required by the speech coder 304 for producing one block of compressed speech information, and would typically be selected as a tradeoff between a desire to use a small buffer size providing less delay and smother adaptation of the sample rate and a desire to use a larger buffer size to reduce processing overhead. Thus, the size of the fixed sized buffer may e.g. be selected as 40 samples. The samples received via the fixed size buffer would be inserted into an intermediate buffer provided in the sample rate converter 303. Sample subsequences of the first stream S32 of digital speech samples could then be extracted from the intermediate buffer and processed in similar ways as in the exemplary first embodiment. Thus, if there is no need for sample rate conversion, sample subsequences of 160 samples are extracted from the intermediate buffer and passed transparently to the speech coder 304 while if there is a need for sample rate conversion, at least some sample subsequences of less than or more than 160 samples are extracted from the intermediate buffer and processed into modified sample subsequences of 160 samples each before being passed to the speech coder 304.

As an alternative to providing the required sample rate as a configuration parameter in the fixed terminal, the fixed terminal TE1 could be adapted to measure the average rate at which speech packets conveying blocks of compressed speech information are received from the mobile station MS1 and derive the required sample rate from said average rate.

The invention is not limited to being implemented only in user terminals, but may also be implemented in other nodes of a communication system such as so called media gateways (MGW). When implementing the invention in a media gateway which converts analog phone signals received from another node in the communication system into speech packets, the first stream of digital speech samples would be provided by an analog-to-digital converter in the media gateway. In other media gateways, the first stream of digital speech samples may be provided by a receiving unit for receiving digital speech samples, e.g. PCM-samples, from another node in the communication system.

The invention claimed is:

1. A method for generating speech packets in a first node of a communication system, the method comprising:

providing a first stream of digital speech samples having a first sample rate;

determining that the first sample rate of the first stream of digital speech samples does not match a required sample rate;

generating a second stream of digital speech samples having an average sampling rate equal to the required sample rate by performing sample rate conversion of the first stream of digital speech samples;

generating the speech packets based on the second stream of digital speech samples;

wherein said packet generating includes:

generating blocks of compressed speech information based on the second stream of digital speech samples;

including the generated blocks of compressed speech information in said speech packets;

wherein each speech packet is generated to include one block of compressed speech information; and wherein the blocks of compressed speech information are intended for transmission over a circuit switched radio channel and the required sample rate is selected such that the rate of generating speech packets equals the rate at which the blocks of compressed speech information are transmitted over said radio channel.

2. A method for generating speech packets in a first node of a communication system, the method comprising:

providing a first stream of digital speech samples having a first sample rate;

determining that the first sample rate of the first stream of digital speech samples does not match a required sample rate;

generating a second stream of digital speech samples having an average sampling rate equal to the required sample rate by performing, sample rate conversion of the first stream of digital speech samples;

generating the speech packets based on the second stream of digital speech samples;

wherein the step of determining includes continuously performing measurements to estimate the first sample rate of the first stream of digital speech samples.

3. A method according to claim 2, wherein the first stream of digital speech samples is provided in the first node by performing analog-to-digital conversion of an analog speech signal.

4. A method for generating speech packets in a first node of a communication system, the method comprising:

providing a first stream of digital speech samples having a first sample rate;

determining that the first sample rate of the first stream of digital speech samples does not match a required sample rate;

generating a second stream of digital speech samples having an average sampling rate equal to the required sample rate by performing sample rate conversion of the first stream of digital speech samples;

generating the speech packets based on the second stream of digital speech samples;

wherein the required sample rate is provided as a parameter stored in the first node.

5. A method for generating speech packets in a first node of a communication system, the method comprising:

providing a first stream of digital speech samples having a first sample rate;

determining that the first sample rate of the first stream of digital speech samples does not match a required sample rate;

generating a second stream of digital speech samples having an average sampling rate equal to the required sample rate by performing sample rate conversion of the first stream of digital speech samples;

generating the speech packets based on the second stream of digital speech samples;

for each of at least some subsequences of the first stream of digital speech samples:

creating a LPC-residual by performing LPC-inverse-filtering of the subsequence;

generating a modified LPC-residual comprising at least one sample more or less than the LPC-residual;

generating a subsequence of the second stream of speech samples by performing LPC-filtering of the modified LPC-residual.

6. A method according to claim 5, wherein the step of generating a modified LPC-residual comprises the substeps of:

selecting the position where in the LPC-residual to add or remove a sample; and performing said adding or removing of said sample.

7. A method according to claim 6, wherein the position is selected arbitrarily.

8. A method according to claim 6, wherein the position is found by searching for a segment of the LPC-residual with low energy.

9. A method for generating speech packets in a first node of a communication system, the method comprising the steps of:

providing a first stream of digital speech samples having a first sample rate;

determining that the first sample rate of the first stream of digital speech samples does not match a required sample rate;

generating a second stream of digital speech samples having an average sampling rate equal to the required sample rate by performing sample rate conversion of the first stream of digital speech samples;

generating the speech packets based on the second stream of digit speech samples;

wherein the first stream of digital speech samples is provided in the first node by receiving digital speech samples from a second node in the communication system.

10. A method for generating speech packets in a first node of a communication system, the method comprising the steps of:

providing a first stream of digital speech samples in having a first sample rate;

determining that the first sample rate of the first stream of digital speech samples does not match a required sample rate;

generating a second stream of digital speech samples having an average sampling rate equal to the required sample rate by performing sample rate conversion of time first stream of digital speech samples;

generating the speech packets based on the second stream of digital speech samples;

wherein the means for generating speech packets include a speech coder for generating blocks of compressed speech information based on the second stream of digital speech samples;

wherein the means for generating speech packets are adapted to include one block of compressed speech information in each speech packet; and wherein the blocks of compressed speech information are intended for transmission over a circuit switched radio channel and the required sample rate is selected such that the rate of generating speech packets equals the rate at which the blocks of compressed speech information are transmitted over said radio channel.

11. A communication apparatus for use as a node in a communication system, the communication apparatus comprising:

means for providing a first stream of digital speech samples having a first sample rate;

control means for determining whether the first sample rate of the first stream of digital speech samples matches a required sample rate;

a sample rate converter for generating, upon determining that the first sample rate does not match time required sample rate, a second stream of speech samples having the required sample rate by performing sample rate conversion of the first stream of digital speech samples;

means for generating speech packets based on the second stream of digital speech samples;

wherein the means for determining are adapted to continuously perform measurements to estimate the first sample rate of the first stream of digital speech samples.

12. A communication apparatus according to claim 11, wherein the means for providing a first stream of digital speech samples includes an analog-to-digital converter for performing analog-to-digital conversion of an analog speech signal.

13. A communication apparatus according to claim 11, wherein the communication apparatus is a media gateway.

14. A communication apparatus according to claim 11, wherein the communication apparatus is an end user terminal.

15. A communication apparatus for use as a node in a communication system, the communication apparatus comprising:

means for providing a first stream of digital speech samples having a first sample rate;

control means for determining whether the first sample rate of the first stream of digital speech samples matches a required sample rate;

a sample rate converter for generating upon determining that the first sample rate does not match the required sample rate, a second stream of speech samples having the required sample rate by performing sample rate conversion of the first stream of digital speech samples;

means for generating speech packets based on the second stream of digital speech samples;

wherein the communication apparatus includes a memory unit for storing configuration parameters including the required sample rate.

16. A communication apparatus for use as a node in a communication system, the communication apparatus comprising:

means for providing a first stream of digital speech samples having a first sample rate;

control means for determining whether the first sample rate of the first stream of digital speech samples matches a required sample rate;

a sample rate converter for generating, upon determining that the first sample rate does not match the required sample rate, a second stream of speech samples having the required sample rate by performing sample rate conversion of the first stream of digital speech samples;

means for generating speech packets based on the second stream of digital speech samples;

wherein the sample rate converter is adapted to, for each of at least some subsequences of the first stream of digital speech samples, creating an LPC-residual by performing LPC-inverse-filtering of the subsequence, generating a modified LPC-residual comprising at least one sample more or less than the LPC-residual and generating a subsequence of the second stream of speech samples by performing LPC-filtering of the modified LPC-residual.

17. A communication apparatus according to claim 16, wherein the sample rate converter is adapted to generate the modified LPC-residual by selecting the position where in the LPC-residual to add or remove a sample and performing said adding or removing of said sample.

18. A communication apparatus according to claim 17, wherein the sample rate converter is adapted to select the position arbitrarily.

19. A communication apparatus according to claim 17, wherein the sample rate converter is adapted to select the position by searching for a segment of the LPC-residual with low energy.

20. A communication apparatus for use as a node in a communication system, the communication apparatus comprising:

means for providing a first stream of digital speech samples having a first sample rate;

control means for determining whether the first sample rate of the first stream of digital speech samples matches a required sample rate;

a sample rate converter for generating, upon determining that the first sample rate does not match the required sample rate, a second stream of speech samples having the required sample rate by performing sample rate conversion of the first stream of digital speech samples;

means for generating speech packets based on the second stream of digital speech samples;

wherein the means for providing a first stream of digital speech samples includes a receiving unit for receiving digital speech samples from another node in the communication system.

* * * * *

UNITED STATES PATENT AND TRADEMARK OFFICE

CERTIFICATE OF CORRECTION

PATENT NO. : 7,444,281 B2
APPLICATION NO. : 10/451382
DATED : October 28, 2008
INVENTOR(S) : Sundqvist et al.

It is certified that error appears in the above-identified patent and that said Letters Patent is hereby corrected as shown below:

Column 10, Line 30, in Claim 9, delete “digit” and insert -- digital --, therefor.

Column 10, Line 47, in Claim 10, delete “time” and insert -- the --, therefor.

Column 11, Line 5, in Claim 11, delete “time” and insert -- the --, therefor.

Signed and Sealed this

Twenty-first Day of April, 2009

JOHN DOLL
*Acting Director of the United States Patent and Trademark Office*